US008879937B2

(12) United States Patent
Zaima

(10) Patent No.: US 8,879,937 B2
(45) Date of Patent: Nov. 4, 2014

(54) IMAGE FORMING APPARATUS WITH ELECTRIC FIELD CONTROL

(75) Inventor: Nobuhiko Zaima, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 13/484,473

(22) Filed: May 31, 2012

(65) Prior Publication Data

US 2012/0315055 A1 Dec. 13, 2012

(30) Foreign Application Priority Data

Jun. 10, 2011 (JP) ..... 2011-130510

(51) Int. Cl.
*G03G 15/16* (2006.01)
*G03G 21/00* (2006.01)
*G03G 15/00* (2006.01)

(52) U.S. Cl.
CPC ..... *G03G 15/5041* (2013.01)
USPC ..... 399/49; 399/101

(58) Field of Classification Search
USPC ..... 399/66, 49, 101
See application file for complete search history.

(56) References Cited

U.S. PATENT DOCUMENTS

| | | | | |
|---|---|---|---|---|
| 7,385,737 | B2 | 6/2008 | Zaima | |
| 7,394,999 | B2 | 7/2008 | Zaima | |
| 7,577,371 | B2 | 8/2009 | Zaima | |
| 7,684,715 | B2 | 3/2010 | Zaima | |
| 7,949,269 | B2 * | 5/2011 | Takeuchi | 399/66 |
| 2003/0128381 | A1 | 7/2003 | Zaima | |
| 2004/0141776 | A1 * | 7/2004 | Sohmiya et al. | 399/309 |
| 2012/0087683 | A1 * | 4/2012 | Takayanagi | 399/49 |

FOREIGN PATENT DOCUMENTS

| | | | |
|---|---|---|---|
| JP | 2003-202711 | A | 7/2003 |
| JP | 2004-309696 | A | 11/2004 |
| JP | 2006-91179 | A | 4/2006 |
| JP | 2007-47554 | A | 2/2007 |
| JP | 2008-89657 | A | 4/2008 |

* cited by examiner

*Primary Examiner* — Quana M Grainger
(74) *Attorney, Agent, or Firm* — Fitzpatrick, Cella, Harper & Scinto

(57) ABSTRACT

In an apparatus which forms an adjustment toner image outside an image area in a direction orthogonal to a moving direction of an image bearing member, a toner change amount of the adjustment toner image which is directly transferred onto and adheres to a transfer roller without interposing a recording medium differs depending on a transfer electric field. Since the transfer electric field is in a direction for reversing a charging polarity of the toner, when the transfer electric field is large, the toner charge amount of the adjustment toner image is reduced. Therefore, in case that the transfer electric field is large, the cleaning electric field is set small. Thereby the toner of the adjustment toner image can be sufficiently cleaned off by an electrostatic cleaning member irrespective of the transfer voltage, and contamination on a back side of a recording material can be avoided.

16 Claims, 8 Drawing Sheets

| | THICK PAPER 200 g | PLAIN PAPER 80 g | SHEET GAP |
|---|---|---|---|
| (a) TRANSFER BIAS | 3500 V | 2800 V | 2000 V |
| (b) CURRENT FLOWING THROUGH PATCH | 88 μA | 70 μA | 50 μA |
| (c) PATCH TONER CHARGE AMOUNT | −5 μC/g | −10 μC/g | −30 μC/g |
| (d) CLN CURRENT | 2 μA | 4 μA | 12 μA |

| | RECORDING MATERIAL | | |
|---|---|---|---|
| CLN CURRENT CONTROLLING METHOD | SHEET GAP | PLAIN PAPER | THICK PAPER |
| FIRST EMBODIMENT | CLEAN | CLEAN | CLEAN |
| FIXED AT +12 μA | CLEAN | SOILED | SOILED |
| FIXED AT +4 μA | SOILED | CLEAN | SOILED |
| FIXED AT +2 μA | SOILED | SOILED | CLEAN |

IMAGE FORMING APPARATUS WITH ELECTRIC FIELD CONTROL

BACKGROUND OF THE INVENTION

1. Field of the Invention

The present invention relates to an image forming apparatus such as an electrophotographic copying machine or a laser printer, and more particularly to an apparatus which cleans a transfer member that transfers a toner image from an image bearing member to a recording material.

2. Description of the Related Art

In an image forming apparatus, there is an increasing demand for the density/color quality to look the same from a first image to a last image when a plurality of the same images is output. A configuration that an adjustment toner image (a patch) is formed at a non-image position and image control is carried out has been conventionally known. For example, there is also known an apparatus that forms a patch between an image and an image (a sheet gap) and is disclosed in Japanese Patent Application Laid-Open No. 2003-202711. Further, as disclosed in Japanese Patent Application Laid-Open No. 2006-91179 and Japanese Patent Application Laid-Open No. 2007-47554, there is also known an apparatus that forms a patch outside an image area in a direction orthogonal to a moving direction of an image bearing member.

This patch is formed on an image bearing member such as a photosensitive drum or an intermediate transfer belt, and then passes through a position at which a transfer member such as a transfer roller, which is configured to transfer a toner image from the image bearing member onto a recording medium, is present. In this case, there has been conventionally known an apparatus that keeps the transfer member away from the image bearing member so that the patch cannot be transferred onto the transfer member. Furthermore, as disclosed in Japanese Patent Application Laid-Open No. 2004-309696 and Japanese Patent Application Laid-Open No. 2008-89657, there is also known an apparatus that clean off toner adhering to a transfer member without separating the toner member.

For example, a fur brush abutting on a transfer roller is provided, and a bias having a polarity opposite to that of toner is applied to the fur brush through a bias roller, whereby the toner adhering to the transfer roller is transferred to the fur brush. Moreover, the toner that has transferred to the fur brush is further transferred to the bias roller, and the toner adhering to the bias roller is scraped off using a blade or the like.

When forming a patch image outside an image area in a direction orthogonal to a moving direction of an image bearing member, a toner image in the image area is transferred onto a recording material and, at the same time, patch toner is transferred onto a transfer member. That is, the patch image is formed outside the image area in the direction orthogonal to the moving direction of the image bearing member. Therefore, when a transfer voltage is applied to the transfer member in order to transfer an image onto the recording material, the patch toner present in a region where the recording material is not interposed is directly transferred onto the transfer member at the same time. The patch toner transferred onto the transfer member is collected by the fur brush when a bias having a polarity opposite to that of the toner is applied to the fur brush. However, the toner may not be sufficiently collected depending on a bias that is applied to the fur brush.

Usually, an absolute value of a transfer bias for thick paper is set larger than that for plain paper. Therefore, the thick paper has a higher current flowing through a patch image portion present in a region where the paper is not interposed on the outer side along the longitudinal direction of the recording material than the plain paper in dependence upon a set voltage. In case that the toner is electrically charged to have the negative polarity, when a transfer current having the positive polarity is large, a change amount of the toner having the negative polarity is shifted to the positive polarity which is the opposite polarity, and the charge amount of the toner is reduced. Therefore, when a current value applied to the fur brush is set constant irrespective of a transfer voltage, an appropriate electric field associated with the charge amount of the patch toner is not formed. For example, when the current value is too small for the charge amount of the patch toner, the electric field is insufficient, and the toner cannot be sufficiently collected to the fur brush. When the current value is too large for the charge amount of the patch toner, the polarity of the toner is reversed, and the toner cannot be likewise sufficiently collected to the fur brush. If the toner is not sufficiently collected from the transfer member, a back side of the recording material that passes through the transfer member is contaminated.

SUMMARY OF THE INVENTION

With the view of the above-described problem, in an apparatus that forms a path image outside an image area in a direction orthogonal to a moving direction of an image bearing member, it is an object of the present invention to sufficiently collect toner of a patch image transferred to a transfer member at the time of transfer since the image is formed in a region where a recording material is not present by using electrostatic cleaning member having an appropriate electric field applied thereto and to avoid contamination on a back side of the recording material made by the toner adhering to the transfer member.

According to an exemplary embodiment of the present invention, there is provided an image forming apparatus including: a movable image bearing member; a toner image forming unit which forms a toner image on the image bearing member; a transfer member which constitutes a transfer portion where a transfer electric field is formed, that enables transferring the toner image on the image bearing member onto a recording material, the transfer member transferring the toner image in a image area onto the recording material, an adjustment toner image being transferred onto the transfer member; a detection member which detects the adjustment toner images, which are formed in an outside area, which is located outside of an image area of the image bearing member in a direction orthogonal to a moving direction of the image bearing member; an adjustment portion which adjusts toner image forming conditions of the toner image forming unit in accordance with an output from the detection member; a cleaning member which comes into contact with the transfer member at a cleaning portion and electrostatically cleans off toner adhering to the transfer member by application of an electric field that allows the toner having a normal charging polarity to move toward the cleaning member; and a control portion which sets an electric field formed at the cleaning portion so that an electric field formed at the cleaning portion when the electric field formed at the transfer portion is a first transfer electric field is smaller than an electric field formed at the cleaning portion when the electric field formed at the transfer portion is a second transfer electric field smaller than the first transfer electric field.

According to the present invention, in the apparatus that forms an adjustment toner image to be formed outside the image area in the direction orthogonal to the moving direction of the image bearing member, the toner of the adjustment toner image adhering to the transfer member can be cleaned off by using the cleaning member irrespective of the setting of the transfer. Therefore, occurrence of the contamination on the back side due to the toner adhering to the transfer member can be reduced.

Further features of the present invention will become apparent from the following description of exemplary embodiments with reference to the attached drawings.

DESCRIPTION OF THE EMBODIMENTS

Figure 1:
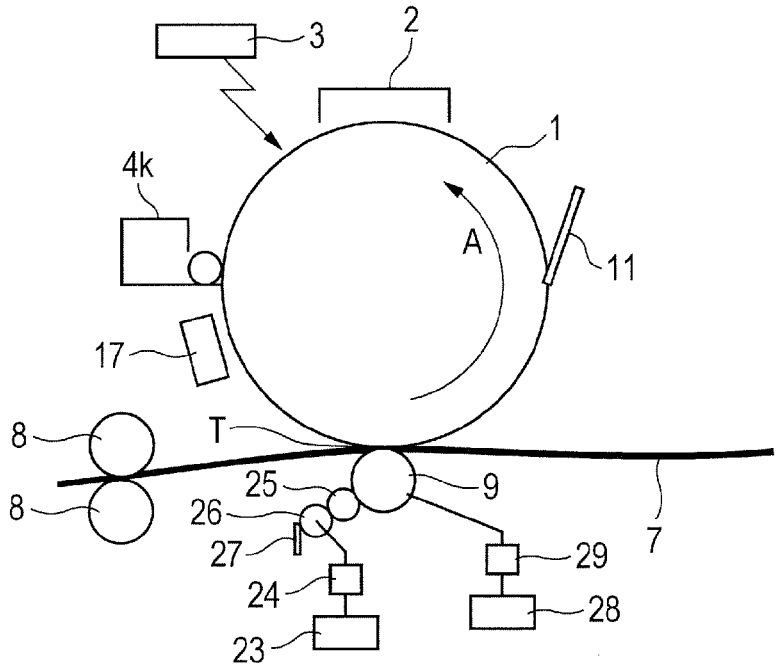
FIG. 1 is a schematic view showing an outline configuration of an image forming apparatus according to a first embodiment of the present invention.

Embodiments of the present invention will now be described in detail in accordance with the accompanying drawings.

<First Embodiment>

A first embodiment according to the present invention will be described with reference to FIG. 1 to FIG. 10. First, an image forming apparatus according to this embodiment will be explained in conjunction with FIG. 1.

[Image Forming Apparatus]

A photosensitive drum (an image bearing member) 1 rotates in a direction of an arrow A, and its surface is uniformly charged by a charging device 2. An exposure device 3 performs exposure based on image information. Based on a well-known electrophotographic process, an electrostatic latent image associated with the image information is formed on the photosensitive drum 1. A developing device 4*k* contains black (k) toner. The electrostatic latent image is developed by this developing device 4*k*, and a toner image is formed on a surface of the photosensitive drum 1. A reversal development system that attaches the toner to an exposed portion of the electrostatic latent image and performs development is adopted. In this embodiment, the charging device 2, the exposure device 3, and the developing device 4*k* constitute toner image forming unit. The toner used for the development has a negative normal charge polarity, and it is charged to the negative polarity by the developing device 4*k*.

An unfixed toner image on the photosensitive drum (on the image bearing member) is transferred onto a recording material 7 at a transfer portion T. At the transfer portion T, a transfer roller 9 as a transfer member is arranged so as to face the photosensitive drum 1. When a predetermined electric field is formed at the transfer portion T, the toner image is transferred onto the recording material from the photosensitive drum. The transfer electric field is a difference between a transfer bias and a potential on the surface of the photosensitive drum 1 where the toner image is present. A constant voltage bias (a transfer bias) having a polarity, which differs from that of the toner, controlled to a predetermined level is applied to the transfer roller 9 from a power supply 28 which is transfer bias applying unit. As a result, the toner image is transferred onto the recording material 7 from the photosensitive drum 1. The transfer bias applied from the power supply 28 is detected by transfer high voltage detecting unit 29.

In order to stably perform the excellent transfer onto the recording material, a transfer bias value is preset by using a type of the recording material as a condition so that a transfer electric field can be always constant, namely, a current flowing through the recording material can be always constant. As to the transfer bias value, an optimum value under each condition is measured at the time of design, and it is stored as a transfer bias table. For example, it is assumed that 2800 V is set for plain paper having a basis weight of 80 g/m$^2$ and 3500 V is set for thick paper having a basis weight of 200 g/m$^2$. To flow the same amount of current through a sheet gap, a transfer bias of 2000 V is set.

Transfer residual toner on the surface of the photosensitive drum 1 after the transfer is cleaned off by a cleaning device 11. Moreover, the above-described image forming step is repeated. The recording material 7 onto which the toner image is transferred is temporarily positioned and stopped by a resist roller 8, and then fed to the transfer portion T at predetermined timing. The recording material 7 having the toner image transferred thereto is conveyed to a non-illustrated fixing device by a non-illustrated conveying member, and the toner image is fused and fixed on the recording medium 7.

Figure 2:
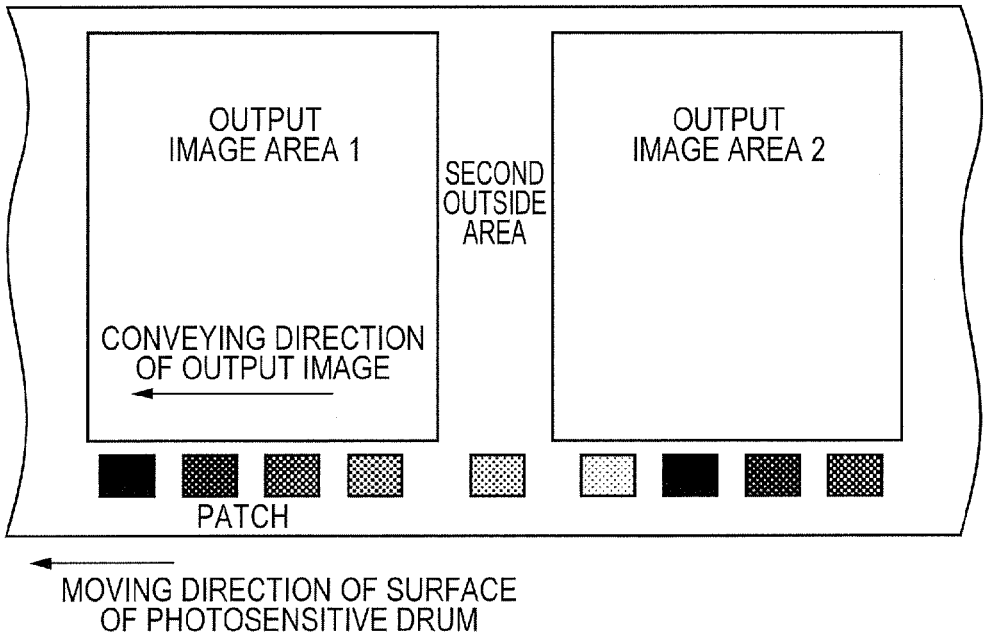
FIG. 2 is a schematic view showing forming positions of patches on a photosensitive drum.
Figure 3:
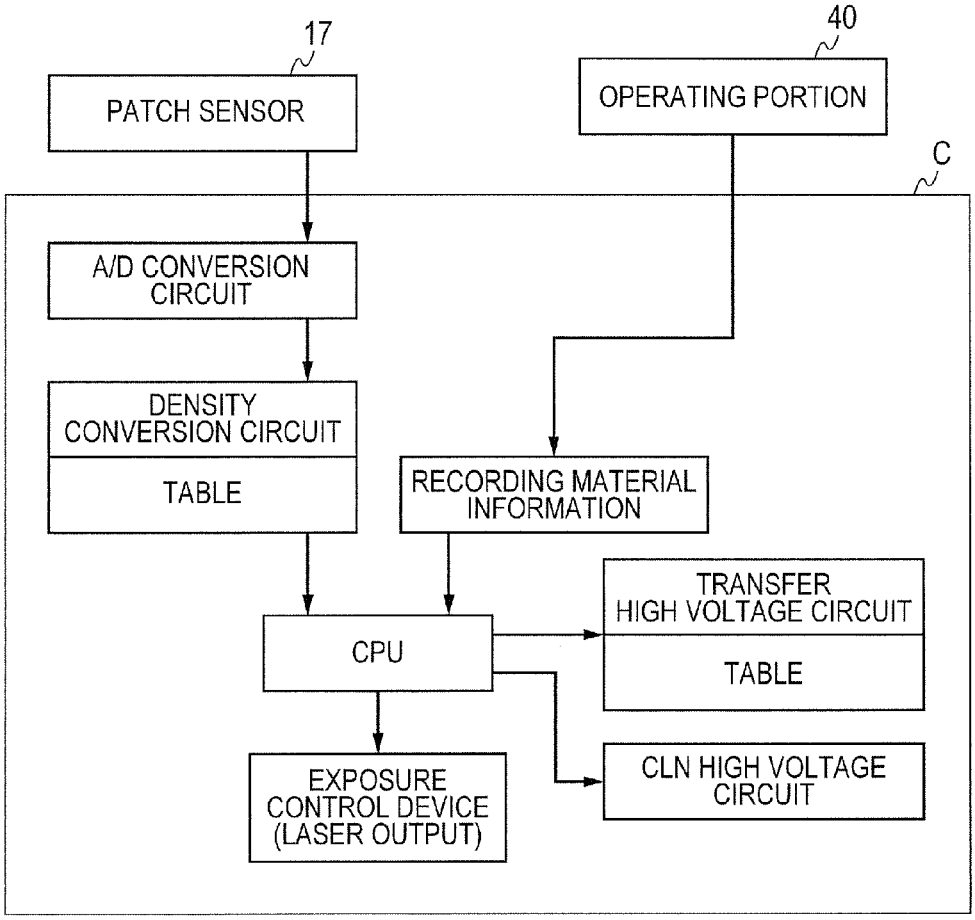
FIG. 3 is a control block diagram for adjusting image forming conditions based on detection of the patches.

A patch sensor 17 detects density of an adjustment toner image (a patch) on the photosensitive drum 1. As shown in FIG. 2, to stabilize and control images, the adjustment toner images (the patches) are continuously formed in a sub-scanning direction (a moving direction of the surface of the photosensitive drum, or a rotating direction) while changing colors or density.

In this embodiment, the toner image forming unit can form the adjustment toner images outside an image area (in first and second outside areas of an outside area) in a direction orthogonal to a moving direction of an image bearing member in parallel with the toner image, that is transferred onto the recording material 7, in a rotation axis direction of the photosensitive drum 1 (a direction orthogonal to a moving direction of the image bearing member, or a main scanning direction). As shown in FIG. 2, the plurality of patches are aligned and formed in a sub-scanning direction outside the image area of the toner image (an output image area 1 or 2) that is transferred onto the recording material 7 in the direction orthogonal to the moving direction of the image bearing member. A shape of one patch has, e.g., a length of 20 mm in the sub-scanning direction and a length of 16 mm in the main scanning direction (the direction which is orthogonal to the sub-scanning direction and orthogonal to the moving direction of the image bearing member). It is to be noted that the patches are prevented from being formed on the extension of the main scanning direction in an area cutting across the output image area and a sheet gap area (the second outside area) in the sub-scanning direction.

The density of each patch formed on the photosensitive drum 1 in this manner is detected by the patch sensor 17, and image control of the toner is carried out in accordance with a result of this detection. It is to be noted that the patch density is a value obtained by measurement using a density measuring instrument (manufactured by X-Rite Co.). The toner image in the image area is transferred onto the recording material and, at the same time, the patch toner that is present in an area outside the recording material is directly transferred onto the transfer roller 9 and adheres to a surface of the transfer roller 9.

A fur brush 25 is cleaning member for the transfer roller. The fur brush 25 rotates while contacting the transfer roller 9 at a cleaning portion. By being applied a bias having a polarity opposite to that of the toner from a power supply 23 through a bias roller 26, the fur brush 25 electrostatically cleans off the patch toner adhering to the transfer roller 9. A difference between a voltage applied to the transfer roller and a voltage applied to the bias roller corresponds to a cleaning electric field at a cleaning portion, and a physical amount corresponding to this cleaning electric field serves as a current flowing between the fur brush 25 and the transfer roller 9. A value of the current flowing through the fur brush 25 is detected by an ammeter 24. The bias applied to the fur brush 25 is determined based on a value of the transfer bias applied to the transfer roller 9 when the patch toner passes through the transfer portion T. The toner that has transferred to the fur brush 25 then transfers to the bias roller 26, and it is scraped off and collected by a cleaning blade 27.

The transfer roller 9 according to this embodiment is, e.g., a roller having a metal cored bar having an outside diameter of 8 to 12 mm and a conductive material layer formed on an outer peripheral surface of the cored bar, and the roller has an outside diameter of 16 to 30 mm. This conductive material layer uses rubber, e.g., polymeric elastomer such as hydrin rubber or EPDM or a polymeric foam material as a base material, and an ionic conductive material is mixed in this material, whereby the conductivity is adjusted to a medium resistive region of 1 [MΩ] to 100 [MΩ]. For a surface layer of the transfer roller 9, a resin coat, e.g. which is formed by coating urethane or nylon at a thickness of 2 to 10 μm, is used. Hardness of the entire transfer roller is 25 to 40 in AskerC.

The fur brush 25 has, e.g., a fur length of 4 mm, a cored bar diameter of 10 mm, and an overall outside diameter of 18 mm. Further, there is used the fur brush 25 whose a resistance value becomes 1E+5 to 1E+10 Ωin measurement in an N/N environment (23° C., 50% RH) when the fur brush 25 is inserted into an opposed metal roller having an outside diameter of 30 mm for a length of 2 mm and a voltage of 100 V is applied while rotating at 100 rpm.

As the bias roller 26, for example, a metal roller of SUS having an outside diameter of 13 to 20 mm is used. Polyurethane rubber having elasticity is used for the cleaning blade 27. The fur brush 25 is inserted into each of the transfer roller 9 and the bias roller 26 for a length of 1 to 2 mm, counter-rotated with respect to the transfer roller 9, and rotated in the forward direction with respect to the bias roller 26.

[Cleaning Bias Control]

A description will now be given as to control for the bias applied to the fur brush 25 which is the cleaning member for the transfer roller 9. This control for the bias is carried out by a control portion C which is a control unit and an adjustment unit depicted in FIG. 3. A signal detected by the patch sensor 17 is supplied to a density conversion circuit through an A/D conversion circuit, converted into a density value associated with the signal by making reference to a table, and fed to a CPU. Furthermore, when a user performs input using an operating portion 40, information of the recording material, e.g., such as information indicative of thick paper or plain paper is supplied to the CPU. Moreover, the CPU determines toner image forming conditions such as a laser output or a transfer bias (a transfer high voltage) applied to the transfer roller 9 and a cleaning current (a cleaning electric field) to be flowed through the fur brush 25. The CPU obtains a cleaning bias from the cleaning electric field and the transfer bias, and outputs them respectively. That is, the control portion C adjusts the toner image forming conditions in accordance with an output from the patch sensor 17 and also controls the cleaning bias.

Figures 4, 5:
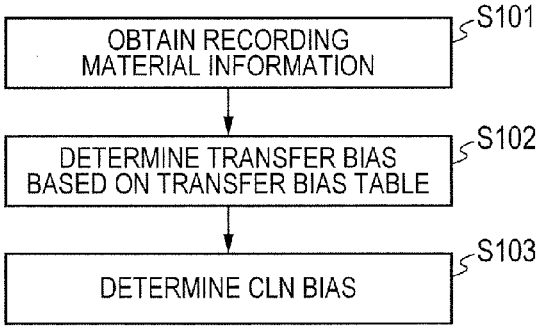
FIG. 4 is a flowchart for determining a cleaning bias.
FIG. 5 shows a relationship between a transfer voltage, a current flowing through the patch, a toner charge amount, and a cleaning current in a sheet gap, thick paper, and plain paper.

In particular, the cleaning bias is determined as shown in FIG. 4. First, the CPU acquires information of the recording material selected by the user through the operating portion 40 (S101). Subsequently, the CPU makes reference to the transfer bias table and determines the transfer bias to be applied to the transfer roller 9 from the recording material information and the information of the patch sensor 17 (S102). Additionally, based on the transfer bias value, the CPU obtains the cleaning current (the cleaning electric field) to be flowed through the fur brush 25, and acquires the cleaning bias based on the transfer bias value and the cleaning electric field (S103).

The transfer bias is changed under the respective conditions in order to fix the current in the output image area where the recording material is present. Therefore, the current flowing through each path formed outside the image area at the transfer portion T is increased to the extent that the recording material is not present, and it changes in accordance with the transfer bias that varies depending on a type of the recording material. When the current flowing through the patch changes, a patch toner charge amount also changes. When the patch toner charge amount changes, a value of the current to be applied to the fur brush 25 also changes in order to clean off the patch toner. In this embodiment, since the patch toner is charged to have the negative polarity, an electric charge of the toner shifts to the positive polarity and the charge amount is reduced as an amount of the current flowing through the patch is increased.

FIG. 5 shows a relationship between the transfer bias and the cleaning current in this embodiment. (a) represents the transfer bias, and it is set in accordance with each recording material type. The transfer bias is set so that the current flowing through each recording material portion is 50 μA, and the stable transfer can be carried out. However, under such conditions, the current flowing through the patch which is in an area that is outside the image area and that has no recording material present therein varies like (b) in accordance with each recording material. A "sheet gap" means, in a continuous image forming, an area between a rear end of the recording material and a distal end of the subsequent recording material in a traveling direction of the recording materials. It is set so that a current flowing therethrough is equal to a current flowing through the recording material portion when the recording material is present. (c) represents a toner charge amount of each patch when the current flows. As compared with each patch in the sheet gap that is transferred under optimum conditions and maintains a toner charge amount, a large amount of current flows through each patch portion in an area outside the recording material to the extent that the recording material is not interposed. Therefore, an absolute value of the toner charge amount in the patch portion is reduced.

(d) represents a cleaning current that is optimum for a toner charge amount of each patch. When an amount of the cleaning current is small as compared with a toner charge amount of the patch, the cleaning electric field is insufficient. On the other hand, when an amount of the cleaning current is extremely large, the polarity of the patch toner is reversed, and the patch toner cannot be sufficiently collected by the fur brush 25. Therefore, in this embodiment, the control portion C controls a voltage or a current applied to the fur brush 25 as follows. That is, the control portion C controls in such a manner that an absolute value of a value of the current flowing through the fur brush 25 when the transfer bias is a first transfer voltage becomes smaller than an absolute value of a value of the current flowing through the fur brush 25 when the transfer bias is a second transfer voltage of which an absolute value is smaller than that of the first transfer voltage.

In (d), the transfer bias when the recording material is thick paper is 3500 V, and the transfer bias when the recording material is plain paper is 2800 V. That is, the transfer bias is the first transfer voltage in case of the thick paper, and the transfer bias is the second transfer voltage in case of the plain paper. The cleaning current at the time of the thick paper is 2 μA, and it is set smaller than the cleaning current 4 μm in case of the plain paper. In the sheet gap, since the recording material is not present, the transfer bias is small and the current flowing through the patch is also small. Therefore, a reduction in patch toner charge amount is small, and hence the cleaning current is large. (a) of FIG. 6 and (b) of FIG. 6 show timing charts of the cleaning bias, the transfer bias, and the cleaning current in this embodiment.

Figure 6:
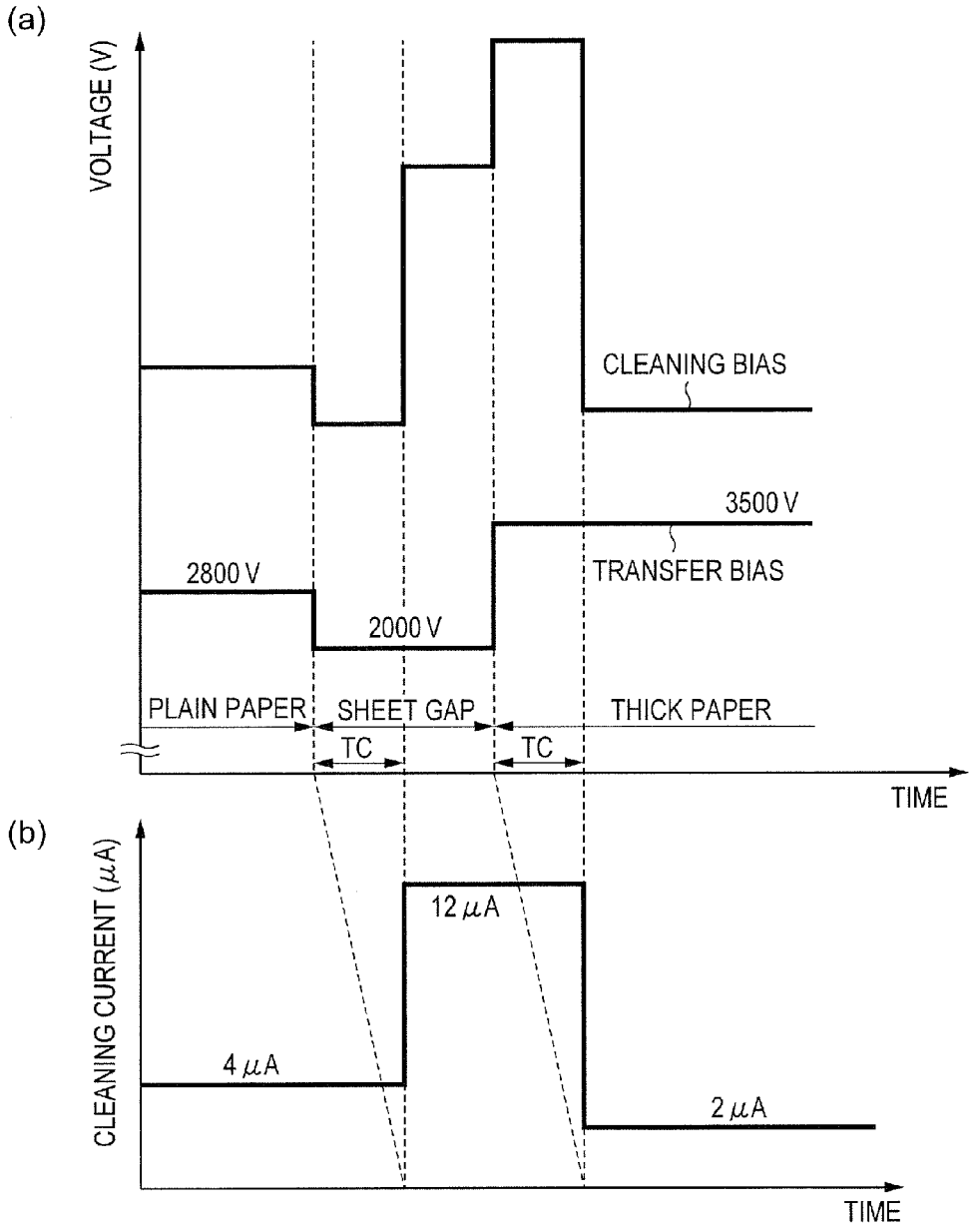
FIG. 6 shows cleaning currents when an image is formed on the plain paper, the sheet gap, and the thick paper.

In (a) of FIG. 6, an abscissa axis represents a time, an ordinate axis represents a voltage, and switching timing of the cleaning bias and the transfer bias is shown. In (b) of FIG. 6, an abscissa axis represents time, an ordinate axis represents the cleaning current (the cleaning electric field), and the absolute time represented by the abscissa axis in (b) of FIG. 6 is matched with that represented by the abscissa axis in (a) of FIG. 6. Since the patch toner charge amount varies at the transfer portion T, a time TC required for a position of the transfer roller present at the transfer portion T to move to the cleaning portion will be considered. In this case, timing for switching the cleaning current (the cleaning electric field) is delayed by TC from a time at which the transfer bias (the transfer electric field) at the transfer portion T is switched. Therefore, the switching timing of the cleaning current (the cleaning electric field) depicted in (b) of FIG. 6 is delayed by TC with respect to the switching timing of the transfer bias shown in (a) of FIG. 6. The cleaning current (the cleaning electric field) is determined based on a difference between the cleaning bias and the transfer bias. Therefore, in order to obtain the cleaning current (the cleaning electric field) depicted in (b) of FIG. 6, a value and the switching timing of the cleaning bias are determined in accordance with a value and the switching timing of the transfer bias as shown in (a) of FIG. 6.

Figure 7:
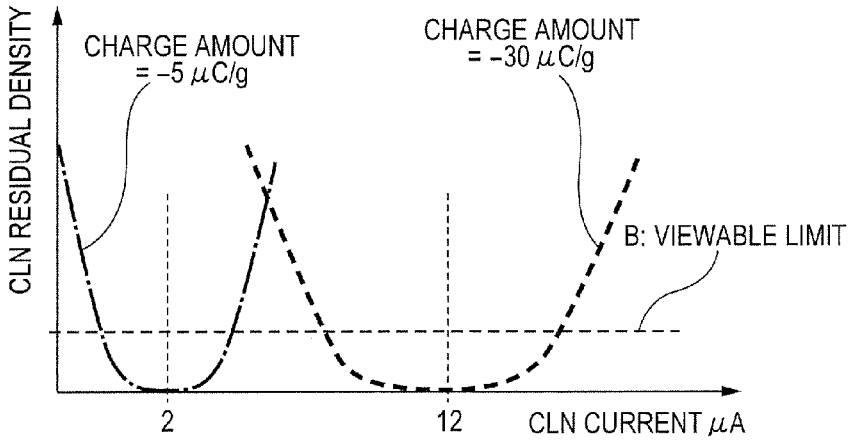
FIG. 7 shows a relationship between a cleaning current and cleaning residual density at each toner charge amount.
Figure 8:
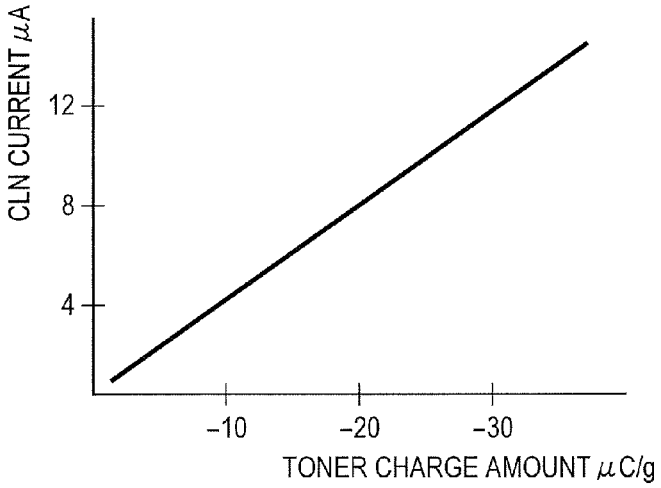
FIG. 8 shows a relationship between a toner charge amount and a cleaning current.

A relationship between the toner charge amount and a cleaning capability for the cleaning current (the cleaning electric field) will now be described in detailed with reference to FIG. 7. An optimum cleaning current for the patches differs depending on a charge amount of the patch toner. In FIG. 7, an ordinate axis represents density when residual toner, which has not been cleaned off, is transferred onto and fixed on the recording material (output paper). When this toner exceeds a visible limit B, it is recognized as contamination and becomes a problem. The visible limit is approximately 0.02 in terms of a density difference with respect to the output paper. Since a charge amount of the patch toner adhering to the transfer roller 9 is affected by high voltage settings in the transferring, the charge amount varies depending on the high voltage settings determined under recording material conditions and the like. FIG. 8 shows a relationship between a toner charge amount and a cleaning current. As obvious from FIG. 8, the cleaning current must be increased as an absolute value of the toner charge amount rises.

Figures 9, 10:
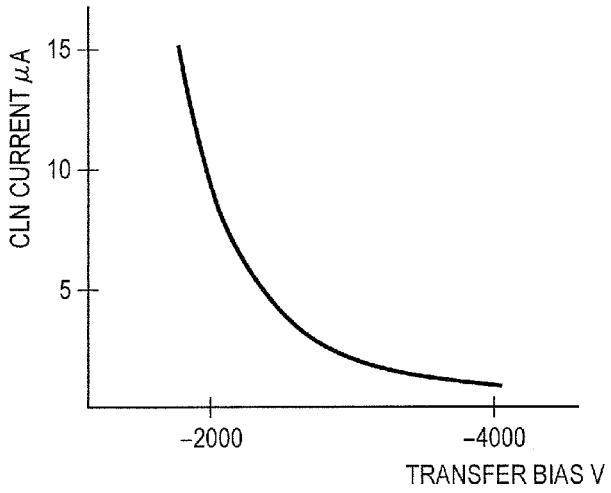
FIG. 9 shows a relationship between a transfer bias and a cleaning current.
FIG. 10 shows a result of an experiment conducted to confirm an effect of the first embodiment.

As a result, the optimum cleaning current (the cleaning electric field) can be obtained based on the transfer bias value as shown in FIG. 9. That is, when the cleaning current is reduced as the absolute value of the transfer bias is increased, the transfer roller 9 can be optimally cleaned. Therefore, in this embodiment, since the transfer bias in a case of the thick paper is larger than that in a case of the plain paper, the smaller cleaning current is flowed in the case of the thick paper. In other words, the voltage or the current applied to the fur brush 25 is controlled in such a manner that a value of the current flowing through the fur brush 25 is reduced as a thickness of the recording material is increased.

According to this embodiment, in the configuration that the patches are aligned and formed in the direction orthogonal to the moving direction of the image bearing member of the toner image that is transferred onto the recording material, the toner adhering to the transfer roller 9 can be sufficiently collected irrespective of a change in transfer voltage (the transfer bias). That is, in a case of the toner having the negative polarity, when the transfer bias is large, an amount of charge injection is increased, and a charge amount of the patch toner is reduced. Therefore, when a large current is flowed without considering a reduction in this charge amount, the polarity of the patch toner is reversed, and the patch toner cannot be sufficiently collected by the fur brush 25. Therefore, in this embodiment, when the transfer bias is large, since the charge amount of the patch toner is reduced, a value of the current flowing through the patch toner (the cleaning current) is decreased. As a result, the transfer roller 9 can be appropriately cleaned using the fur brush 25.

FIG. 10 shows a result of an experiment conducted in order to confirm effects of this embodiment. In this experiment, contamination on the back side of the recording material in this embodiment in which the cleaning current is changed depending on each type of the recording material as shown in FIG. 5 is compared with contamination on the same in three comparative examples in which the cleaning current is fixed irrespective of the types of the recording material. It is determined that the contamination occurred when the contamination on the back side of the recording material exceeds a visible limit depicted in FIG. 7, and it is determined that no contamination occurred when the contamination does not exceed the visible limit.

As obvious from FIG. 10, using the cleaning current control according to this embodiment enables sufficiently cleaning off the patches under all the transfer conditions from the transfer roller 9. On the other hand, when the control according to the comparative examples where the cleaning current is fixed is adopted, the patches under any transfer conditions cannot be sufficiently cleaned off from the transfer rollers 9, and hence the back side of the paper is soiled.

<Second Embodiment>

Figure 11:
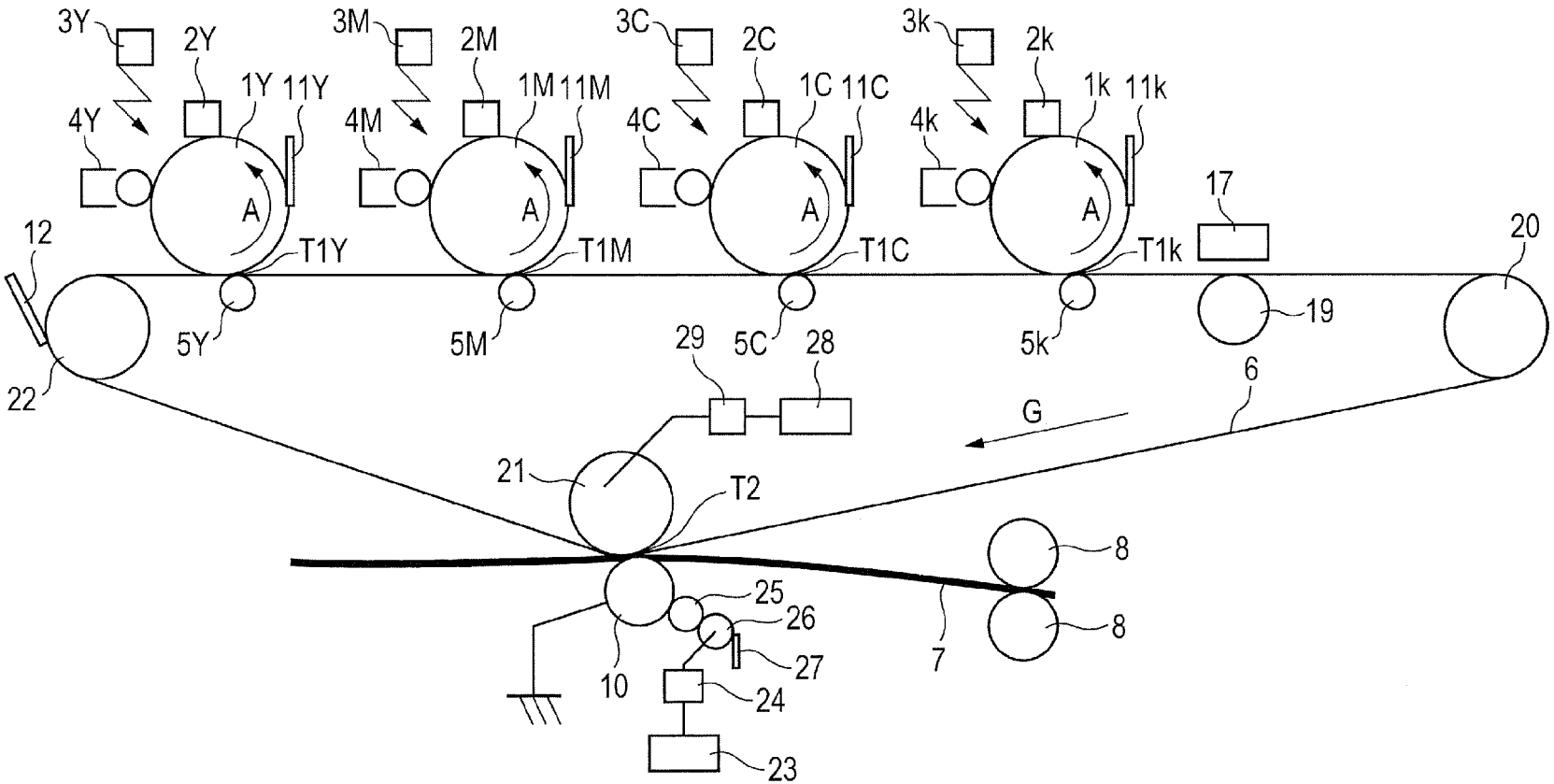
FIG. 11 is a schematic view showing an outline configuration of an image forming apparatus according to a second embodiment of the present invention.
Figure 12:
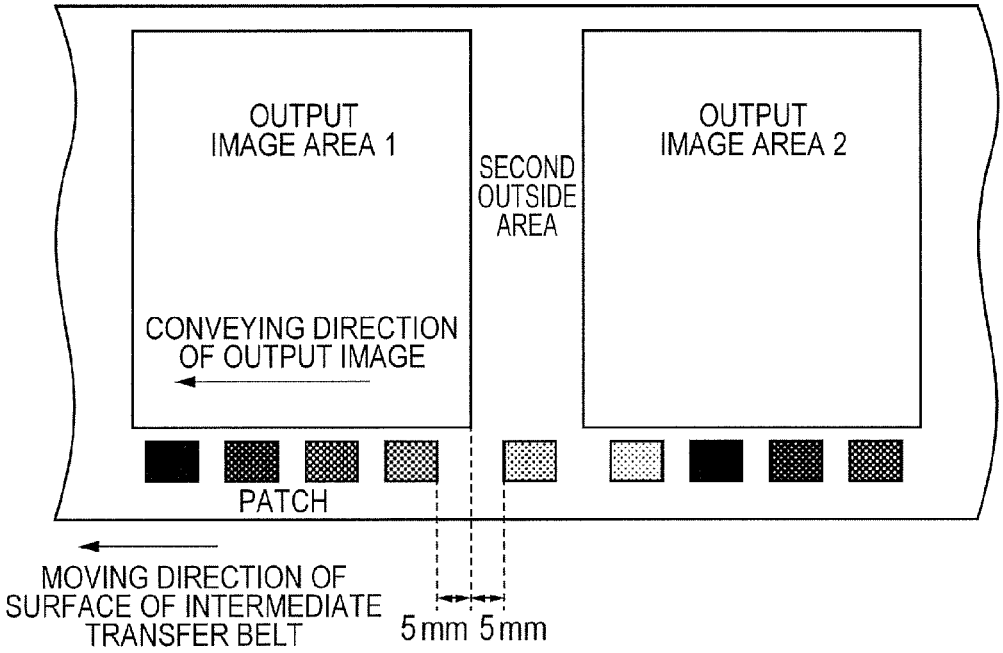
FIG. 12 is a schematic view showing forming positions of patches on an intermediate transfer belt.
Figure 13:
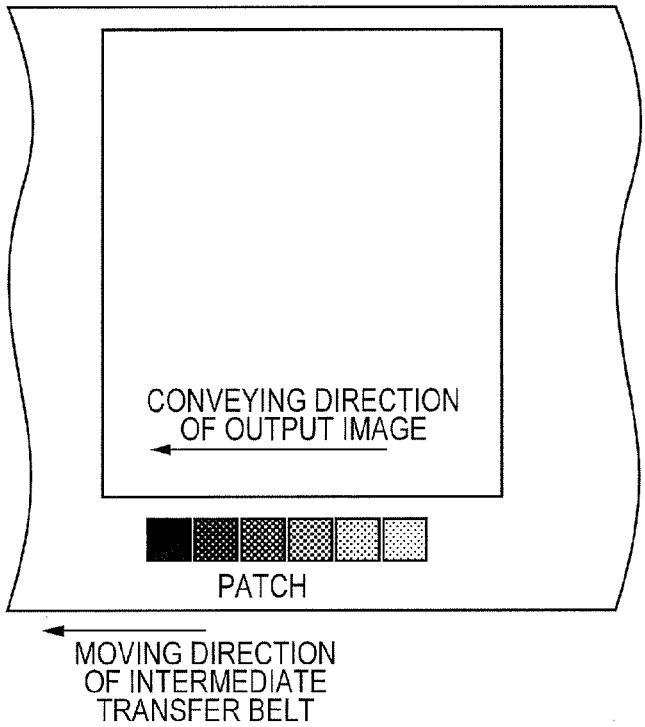
FIG. 13 shows a state in which patches are aligned and formed in a direction orthogonal to a toner image and a moving direction of an image bearing member.

A second embodiment according to the present invention will now be described with reference to FIG. 11 and FIG. 12. In the first embodiment, the configuration adopting the one-colored direct transfer system in which one color, i.e., black (k) alone is directly transferred onto the recording material from the photosensitive drum has been explained. On the other hand, in this embodiment, four colors, i.e., yellow (Y), magenta (M), cyan (C), and black (k) are used to form an image. Further, there is adopted a full-color intermediate transfer system in which transfer from image forming stations of the respective colors to an intermediate transfer belt is performed and then transfer to the recording material is performed. In particular, this embodiment has a tandem type configuration that the image forming stations of the respective colors are aligned and arranged along the intermediate transfer belt.

The photosensitive drums (image bearing members) 1Y, 1M, 1C, and 1*k* rotate in a direction of an arrow A, and surfaces of these drums are uniformly charged by charging devices 2Y, 2M, 2C, and 2*k*. Exposure devices 3Y, 3M, 3C, and 3*k* perform exposure based on image information. Electrostatic latent images associated with the image information are formed on the photosensitive drums 1Y, 1M, 1C, and 1*k* by a well-known electrophotographic process.

Developing devices 4Y, 4M, 4C, and 4*k* contain respective types of chromatic toner of yellow (Y), magenta (M), cyan (C), an black (k). The electrostatic latent images are developed by these developing devices 4Y, 4M, 4C, and 4*k*, and toner images are formed on surfaces of the respective photosensitive drums 1Y, 1M, 1C, and l*k*. There is adopted a reversal development system in which the toner is attached to an exposed portion of the electrostatic latent image and development is performed. A non-illustrated environmental sensor is mounted in the image forming apparatus, and detecting a temperature and relative humidity enables calculating an absolute moisture content in an atmospheric environment.

An intermediate transfer belt (an image bearing member) 6 is arranged so as to abut on the surfaces of the respective photosensitive drums 1Y, 1M, 1C, and 1*k*, stretched on a plurality of stretch rollers 20, 21, and 22, and rotationally moves in a direction of an arrow G. In this embodiment, the stretch roller 20 is a tension roller configured to control the tensile force of the intermediate transfer belt 6 constant, the stretch roller 22 is a driving roller for the intermediate transfer belt 6, and the stretch roller 21 is a secondary transfer opposing roller.

As this intermediate transfer belt 6, there is adopted a belt containing an appropriate amount of carbon black as an antistatic agent in a resin such as polyimide or polycarbonate or various kinds of rubber. This belt has a volume resistivity of 1E+8 to 1E+13 [Ω·cm] and a thickness of 0.07 to 0.1 [mm].

In this embodiment, the intermediate transfer belt 6 having an endless-belt-like shape is arranged so as to face the respective photosensitive drums 1Y, 1M, 1C, and 1*k*. An unfixed toner image on the photosensitive drum 1Y is electrostatically and primary transferred onto the intermediate transfer belt 6 by using a primary transfer roller (a primary transfer member) 5Y. Subsequently, unfixed toner images on the photosensitive drums 1M, 1C, and 1*k* are sequentially and primary transferred so as to overlap each other by using primary transfer rollers 5M, 5C, and 5*k*. Thereby a full-color image is obtained by overlapping the unfixed toner images of four colors on the intermediate transfer belt 6. The transfer residual toner on the surfaces of the respective photosensitive drums 1Y, 1M, 1C, and 1*k* after the primary transfer is cleaned off per one revolution by cleaning devices 11Y, 11M, 11C, and 11*k*. Furthermore, the above-described image forming process is repeated.

In this embodiment, the image forming station of each color has the photosensitive drum 1, the charging device 2, the exposure device 3, the developing device 4, the primary transfer roller 5, and the cleaning device 11 (subscripts Y, M, C, and k are omitted). Each image forming station corresponds to a toner image forming unit.

The primary transfer rollers 5Y, 5M, 5C, and 5*k* are arranged on a back side of the intermediate transfer belt 6 at primary transfer portions T1Y, T1M, T1C, and T1*k*, facing the respective photosensitive drums 1Y, 1M, 1C, and 1*k*, of the intermediate transfer belt 6. A primary transfer bias having the positive polarity which is opposite to the charging polarity of the toner to the respective primary transfer rollers 5Y, 5M, 5C, and 5*k*. As a result, the toner images on the photosensitive drums 1Y, 1M, 1C, and 1*k* are primary transferred onto the intermediate transfer belt 6.

At a secondary transfer portion T2 of the intermediate transfer belt 6 facing a conveying path for a recording material 7, a secondary transfer roller 10 is arranged on a toner image bearing member surface side of the intermediate transfer belt 6 and pressure contacts the surface. The opposing roller 21 arranged on the back side of the intermediate transfer belt 6 serves as an opposed electrode of the secondary transfer roller 10, and a secondary transfer bias is applied. In this embodiment, the secondary transfer roller 10 corresponds to a transfer member.

When transferring the toner image on the intermediate transfer belt 6 (on the image bearing member) onto the recording material 7, a constant voltage bias (a transfer bias) which is controlled in a predetermined manner and has the same polarity as the toner is applied to the opposing roller 21 from a power supply 28 which is a transfer bias applying unit. The transfer bias applied from the power supply 28 is detected by transfer high voltage detecting unit 29.

To stably perform the excellent transfer with respect to the recording material, a secondary transfer bias value is determined by using a type of the recording material and an absolute moisture content of an atmospheric environment as conditions so as to constantly provide a fixed current flowing through the recording material. An optimum value of the secondary transfer bias value under the respective conditions is measured at the time of design, and it is stored as a secondary transfer bias table.

In this embodiment, for example, with a moisture content of 10 g/m3 in the atmospheric environment, −2800 V is set for the plain paper having a basis weight of 80 g/m2, and −3500 V is set for the thick paper having a basis weight of 200 g/m2. In a sheet gap, likewise, a transfer bias of −2000 V is set in order to flow the same amount of current. On the downstream side of the secondary transfer portion T2, a belt cleaner 12 is provided that removes the residual toner on the intermediate transfer belt 6 after the secondary transfer.

In this embodiment, the recording material 7 is fed to the secondary transfer portion T2 at predetermined timing after the recording material 7 is temporarily positioned and stopped by a resist roller 8. Moreover, the recording material 7 after the secondary transfer is conveyed to a non-illustrated fixing device by a non-illustrated conveying member, and the toner is fused and secured on the recording material 7.

A patch sensor 17 detects density of each adjustment toner image (a patch) on the intermediate transfer belt 6. A roller 19 is arranged to abut on the back side of the intermediate transfer belt 6 facing the patch sensor 17. As shown in FIG. 12, the adjustment toner images (the patches) are continuously formed in a sub-scanning direction (a moving direction of the surface of the intermediate transfer belt, a rotating direction) while changing a color or density for image stabilization control.

In this embodiment, the toner image forming unit can form the adjustment toner images in parallel with each toner image transferred onto the recording material 7 in a rotation axis direction (a direction orthogonal to a moving direction of the image bearing member, a main scanning direction) of the intermediate transfer belt 6. Therefore, as shown in FIG. 12, the plurality of patches are aligned in the sub-scanning direction and formed at positions adjacent to the toner image (an output image area 1 or 2) in the direction orthogonal to the moving direction of the image bearing member. A shape of one patch has a length of 20 mm in the sub-scanning direction and a length of 16 mm in the main scanning direction (the direction orthogonal to the moving direction of the image bearing member), for example.

The patches are prevented from being formed on an extended line in the main scanning direction with a width of 5 mm on each of both sides of a boundary between the output image area and the sheet gap area in the sub-scanning direction. This length corresponds to a length of a contact portion (the secondary transfer portion) of the secondary transfer roller 10 and the intermediate transfer belt 6 and a length of a portion (a cleaning portion) where the secondary transfer roller 10 comes into contact with a fur brush 25. As a result, the patches can be formed while avoiding the secondary transfer portion when the secondary transfer bias conditions vary and the cleaning portion when a cleaning bias changes. As a result, an amount of a current flowing through each patch can be accurately estimated.

As described above, density of each patch formed on the transfer belt 6 is detected by the patch sensor 17, and toner image control is carried out in accordance with a result of this detection. Here, the patch density is a value measured by a density measuring instrument (manufactured by X-Rite Co.) when the toner is transferred onto the recording material. Then, the patches adhere to the secondary transfer roller 10 in accordance with the transfer of each output image area onto the recording material.

The fur brush 25 as a cleaning member electrostatically cleans off the patch toner adhering to the secondary transfer roller 10 by using a bias, which has the polarity opposite to that of the toner, applied from the power supply 23 through a bias roller 26. A value of the current flowing through the fur brush 25 is detected by an ammeter 24. The bias applied to the fur brush 25 is determined based on a value of the secondary transfer bias applied to the secondary transfer roller 10 when the patch toner passes through the secondary transfer portion T2. The toner that has transferred to the fur brush 25 then transfers to the bias roller 26, and it is scraped off and collected by a cleaning blade 27.

A configuration of each of the primary transfer roller 5 and the secondary transfer roller 10 is the same as that of the transfer roller 9 according to the first embodiment. Further, a configuration of each of the fur brush 25 and the bias roller 26 is the same as that in the first embodiment. The fur brush 25 is inserted into each of the secondary transfer roller 10 and the bias roller 26 for a length of 1 to 2 mm, and the fur brush 25 is counter-rotated with respect to the secondary transfer roller 10 and rotated in the forward direction with respect to the bias roller 26.

In this embodiment, like the first embodiment, a cleaning bias applied to the fur brush 25 is controlled. In this embodiment, the secondary transfer bias has the same polarity (the negative polarity) as the toner and is applied from the opposing roller 21 side. Therefore, there is a difference from the first embodiment in that the transfer bias has the negative polarity, but any other relations are the same as those shown in, e.g., FIG. 5. That is, the cleaning current is reduced as an absolute value of the secondary transfer bias is increased. In this embodiment, the same experiment as the experiment whose result is shown in FIG. 10 is conducted, and the same result as that shown in FIG. 10 is obtained. Any other configurations and functions are equal to those in the first embodiment.

<Third Embodiment>

A third embodiment according to the present invention will now be described. Although the case that the transfer bias is subjected to the constant voltage control has been described in the first and second embodiments, this transfer bias is subjected to constant current control by using a target current in this embodiment. Although a description will be given with reference to FIG. 1 of the first embodiment, the same is true for the second embodiment.

When transferring an unfixed toner image on a photosensitive drum 1 onto a recoding material 7, a transfer bias having the polarity different from that of the toner is applied to the transfer roller 9 from a power supply 28 subjected to the constant current control, and the toner image is transferred onto the recording material 7. To stably perform the excellent transfer onto the recording material, a target current of the constant current control is determined by using a type and a size (a width) of the recording material and an absolute moisture content in an atmospheric environment as conditions so as to constantly provide the fixed current flowing through the recording material.

The current is affected by a size of the recording material because a larger amount of current flows through a no recording material area than that in a recording material area (a width) in a transfer nip, and hence a target current (a desired current) must be increased as the recording material area is reduced. An optimum value of the target current under the respective conditions is measured at the time of design, and it is stored as a target current table.

The power supply 28 sets a bias that enables obtaining the target current, and thereby the current flowing through the recording material is optimized. A value of the current flowing through a transfer roller 9 is detected by an ammeter 29. In this embodiment, like the first embodiment, the current flowing through the recording material 7 is assumed to be 50 μA. Therefore, the transfer bias is 2800 V for plain paper having a basis weight of 80 g/m2 and 3500 V for thick paper having a basis weight of 200 g/m2, and the transfer bias of 2000 V is provided even in a sheet gap in order to flow the same amount of current.

In this embodiment, like the first embodiment, a cleaning current (a cleaning electric field) is reduced as an absolute value of a secondary transfer bias is increased. Therefore, a voltage or a current applied to the fur brush is controlled in such a manner that a value of the current flowing through the fur brush 25 is reduced as a thickness of the recording material is increased. Additionally, in this embodiment, since the transfer bias is subjected to the constant current control, the transfer bias is affected by a size (a width) of the recording material. Therefore, the voltage or the current applied to the fur brush 25 is controlled in such a manner that the target current is reduced and a value of the current flowing through the fur brush 25 is decreased as the width of the recording material is increased. Any other configurations and functions are equal to those in the first embodiment.

<Other Embodiment>

Although the cleaning bias is determined in accordance with the recording material information such as a thickness of a width of the recording material in each of the foregoing embodiments, the cleaning bias may be controlled in accordance with an environment in the apparatus. That is, as described above, the transfer bias is determined while considering an absolute moisture content in the atmospheric environment. Therefore, when the cleaning bias is determined while considering this absolute moisture content, the transfer roller can be more efficiently cleaned. Therefore, when an environmental sensor that detects an environment in the apparatus and calculates an absolute moisture content is provided, a control portion controls a voltage or a current applied to cleaning member (a fur brush) as follows. That is, the voltage or the current applied to the cleaning member is controlled in such a manner that a transfer bias is reduced and a value of the current (a cleaning electric field) flowing through the cleaning member is decreased as the absolute water content calculated by the environmental sensor is reduced. It is to be noted that, such an absolute moisture content and information of the recording material are combined and reflected in the cleaning current.

Further, although the image forming apparatus using the toner charged to have the negative polarity has been described in each of the foregoing embodiments, the present invention can be likewise applied to a configuration using the toner charged to have the positive polarity.

Although the embodiments according to the present invention have been described, the present invention is not restricted to the foregoing embodiments, and it can be modified in many ways within the technical concept of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-130510, filed Jun. 10, 2011 which is hereby incorporated by reference herein in its entirety.

What is claimed is:

1. An image forming apparatus comprising:

a movable image bearing member;

a toner image forming unit which forms a toner image and a plurality of adjustment toner images on the image bearing member;

a transfer member which constitutes a transfer portion where a transfer electric field is formed, that enables transferring the toner image on the image bearing member onto a recording material, the transfer member transferring the toner image in an image area onto the recording material, wherein the adjustment toner images are transferred onto the transfer member;

a detection member which detects the adjustment toner images, which are formed in an outside area, which is located outside of the image area of the image bearing member in a direction orthogonal to a moving direction of the image bearing member;

an adjustment portion which adjusts toner image forming conditions of the toner image forming unit in accordance with an output from the detection member;

a cleaning member which comes into contact with the transfer member at a cleaning portion and electrostatically cleans off toner adhering to the transfer member by application of a cleaning electric field that allows the toner having a normal charging polarity to move toward the cleaning member; and a control portion which sets the cleaning electric field so that the cleaning electric field when the transfer electric field is a first transfer electric field is smaller than the cleaning electric field when the transfer electric field is a second transfer electric field smaller than the first transfer electric field.

2. The image forming apparatus according to claim 1, wherein the adjustment toner images are respectively formed in a plurality of independent areas, at least in the moving direction of the image bearing member.

3. The image forming apparatus according to claim 2, wherein the outside area includes first and second outside areas, wherein the first outside area is located along the image area of the image bearing member in a direction orthogonal to the moving direction of the image bearing member, the second outside area is located along an area between the image area and a subsequent image area of the image bearing member in a direction orthogonal to the moving direction of the image bearing member, and wherein during continuous image forming, the adjustment toner images are formed in the first and second outside areas.

4. The image forming apparatus according to claim 3, wherein each independent area of the adjustment toner images is formed to be included in either the first outside area or the second outside area.

5. The image forming apparatus according to claim 4, wherein each independent area of the adjustment toner images is formed in an area which is 5 mm or more apart in the moving direction of the image bearing member from a boundary between the first outside area and the second outside area.

6. The image forming apparatus according to claim 4, wherein during continuous image forming, the control portion switches the transfer electric field to an electric field corresponding to the second outside area when a part of the second outside area reaches the transfer portion in the moving direction of the image bearing member, and switches the transfer electric field to an electric field corresponding to the first outside area when a part of the first outside area reaches the transfer portion in the moving direction of the image bearing member.

7. The image forming apparatus according to claim 6, wherein the control portion delays timing of switching the cleaning electric field, with respect to timing of switching the transfer electric field for a time, until an area of the transfer member placed at the transfer portion first reaches the cleaning portion when the transfer electric field is switched.

8. The image forming apparatus according to claim 1, wherein the cleaning member is a rotatable fur brush.

9. The image forming apparatus according to claim 8, further comprising:

a bias roller which contacts the fur brush;

a power supply which forms an electric field between the bias roller and the fur brush; and a cleaning blade which contacts with the bias roller.

10. The image forming apparatus according to claim 1, wherein the image bearing member is a photosensitive member, and the transfer member is a transfer roller.

11. The image forming apparatus according to claim 1, wherein the image bearing member is an intermediate transfer member, and the transfer member is a transfer roller arranged so as to face a surface of the intermediate transfer member where the toner image is born.

12. The image forming apparatus according to claim 1, wherein the image bearing member is an intermediate transfer member, and the transfer member is a roller which is arranged so as to face a surface of the intermediate transfer member opposite to a surface of the intermediate transfer member where the toner image is born and the roller contacts with the intermediate transfer member.

13. The image forming apparatus according to claim 1, wherein a voltage is applied to the transfer member by a constant voltage power supply.

14. The image forming apparatus according to claim 1, wherein a voltage is applied to the transfer member by a constant current power supply.

15. The image forming apparatus according to claim 1, further comprising:

an operating portion which enables a user to input information concerning a thickness of the recording material, wherein the control portion sets the cleaning electric field so that the cleaning electric field when the thickness of the recording material input through the operating portion is a first thickness, is smaller than the cleaning electric field when the thickness of the recording material input through the operating portion is a second thickness thinner than the first thickness.

16. The image forming apparatus according to claim 1, further comprising:

an environmental sensor which detects a moisture content in air in the apparatus, wherein the control portion sets the cleaning electric field so that the cleaning electric field when a result of the detection of the environmental sensor is a first moisture content, is smaller than the cleaning electric field when a result of the detection of the environmental sensor is a second moisture content smaller than the first moisture content.

* * * * *